US009883266B2

(12) United States Patent
Dai et al.

(10) Patent No.: US 9,883,266 B2
(45) Date of Patent: Jan. 30, 2018

(54) LOUDSPEAKER MODULE AND ELECTRONIC DEVICE COMPRISING THE LOUDSPEAKER MODULE

(71) Applicant: GOERTEK INC., WeiFang, ShanDong Province (CN)

(72) Inventors: Zhigan Dai, WeiFang (CN); Di Wu, WeiFang (CN); Huiyu Li, WeiFang (CN); Xinfeng Yang, WeiFang (CN)

(73) Assignee: GOERTEK INC., Wei Fang, Shandong Province (CN)

( * ) Notice: Subject to any disclaimer, the term of this patent is extended or adjusted under 35 U.S.C. 154(b) by 0 days.

(21) Appl. No.: 15/108,255

(22) PCT Filed: Apr. 28, 2014

(86) PCT No.: PCT/CN2014/076367
§ 371 (c)(1),
(2) Date: Jun. 24, 2016

(87) PCT Pub. No.: WO2015/096334
PCT Pub. Date: Jul. 2, 2015

(65) Prior Publication Data

US 2016/0323675 A1 Nov. 3, 2016

(30) Foreign Application Priority Data

Dec. 25, 2013 (CN) ..... 2013 1 0727185

(51) Int. Cl.
*H04R 1/02* (2006.01)
*H04R 9/06* (2006.01)
(Continued)

(52) U.S. Cl.
CPC ..... *H04R 1/021* (2013.01); *H04R 1/025* (2013.01); *H04R 1/288* (2013.01); *H04R 1/2811* (2013.01);
(Continued)

(58) Field of Classification Search
CPC ..... H04R 1/02; H04R 1/021; H04R 1/023; H04R 1/025; H04R 1/2811; H04R 1/2888; H04R 2499/11; H04R 2499/15
See application file for complete search history.

(56) References Cited

U.S. PATENT DOCUMENTS 6,763,110 B1 * 7/2004 Sung ..... H04M 1/0202 379/433.02
8,885,867 B1 * 11/2014 Tai ..... H04R 1/345 381/333
(Continued)

FOREIGN PATENT DOCUMENTS

CN 201349232 Y 11/2009
CN 202395966 U 8/2012
(Continued)

OTHER PUBLICATIONS

State IP Office of the People's Republic of China, Office Action dated Nov. 30, 2016 from corresponding Chinese application 201310727185.1.
(Continued)

*Primary Examiner* — Matthew Eason
(74) *Attorney, Agent, or Firm* — Holzer Patel Drennan

(57) ABSTRACT

A loudspeaker module comprises a loudspeaker unit and a module housing. A front acoustic cavity and a rear acoustic cavity are formed between the module housing and the loudspeaker unit. The upper and lower ends of the front acoustic cavity and the rear acoustic cavity are open. The upper and lower end surfaces of the module housing are combined with a terminal electronic device through sealing cushions. An electronic device is also disclosed. The upper and lower surfaces of the module housing are combined with the circuit board or the device housing through sealing cushions. Such a structure fully utilizes the spaces of the loudspeaker module and the electronic device, expands the
(Continued)

internal space of the loudspeaker module, increases the sizes of the loudspeaker unit and the sound cavities, and accordingly improves the acoustical performance of the product.

10 Claims, 6 Drawing Sheets

(51) Int. Cl.
*H04R 1/28* (2006.01)
*H04R 1/38* (2006.01)
*H04R 31/00* (2006.01)

(52) U.S. Cl.
CPC ..... *H04R 1/2819* (2013.01); *H04R 1/38* (2013.01); *H04R 9/06* (2013.01); *H04R 31/006* (2013.01); *H04R 2499/11* (2013.01)

(56) References Cited

U.S. PATENT DOCUMENTS 9,479,850 B2* 10/2016 Lee ..... H04M 1/035
2001/0009586 A1* 7/2001 Suzuki ..... H04R 1/2811 381/151
2002/0187758 A1* 12/2002 Ylitalo ..... H04R 5/0335 455/575.1
2007/0116321 A1* 5/2007 Jang ..... H04M 1/035 381/388
2009/0291718 A1* 11/2009 Fukazawa ..... H04M 1/03 455/575.1
2012/0275637 A1* 11/2012 Liao ..... H04R 1/025 381/395
2013/0070947 A1* 3/2013 Chien ..... H04R 1/2803 381/332
2013/0070956 A1* 3/2013 Yamanaka ..... H04R 1/025 381/433
2014/0023223 A1* 1/2014 Hwang ..... H04R 1/025 381/386
2014/0193024 A1* 7/2014 Raff ..... H04R 1/02 381/394
2014/0294225 A1* 10/2014 Ji ..... H04R 1/023 381/386
2014/0301587 A1* 10/2014 Ji ..... H04R 1/025 381/332
2016/0165327 A1* 6/2016 Crosby ..... H04R 1/2811 381/332
2016/0225362 A1* 8/2016 Xu ..... G10K 11/002
2016/0227304 A1* 8/2016 Xu ..... H04R 1/021
2016/0227314 A1* 8/2016 Cai ..... H04R 1/2888
2016/0295316 A1* 10/2016 Shao ..... H04R 1/025
2017/0055065 A1* 2/2017 Zhang ..... H04R 1/2803
2017/0208386 A1* 7/2017 Yang ..... H04R 1/288

FOREIGN PATENT DOCUMENTS

CN 202841449 U 3/2013
CN 103108268 A 5/2013
CN 103108269 A 5/2013
CN 103747398 A 4/2014
CN 203851284 U 9/2014
JP 2005086220 A 3/2005

OTHER PUBLICATIONS

State IP Office of the People's Republic of China, Office Action dated Apr. 6, 2016 from corresponding Chinese application 201310727185.1.

* cited by examiner

LOUDSPEAKER MODULE AND ELECTRONIC DEVICE COMPRISING THE LOUDSPEAKER MODULE

TECHNICAL FIELD

The present invention relates to the technical field of electro-acoustic products, more specifically, to a loudspeaker module and an electronic device comprising the loudspeaker module.

BACKGROUND

At present, the requirements on portable electronic devices by consumers tend to thin-type day by day, and thus the electronic components in the electronic devices tend to thin-type day by day. Wherein, a loudspeaker unit, as an important acoustic element, tends to thin-type day by day as well. The loudspeaker comprises a vibrating diaphragm for radiating sound. As the difference between the phases of sounds radiated to the front side and the rear side of the vibrating diaphragm is 180 degree, the front acoustic cavity and the rear acoustic cavity should be mutually spaced. In order to avoid defects, such as, the front acoustic cavity being not spaced from the rear acoustic cavity completely, due to installing the loudspeaker unit in the electronic device directly, typically, the loudspeaker unit is provided in a peripheral frame in advance to form a loudspeaker module, and form a closed rear acoustic cavity and a front acoustic cavity only in communication with a sound outlet hole, and then the loudspeaker module is installed in the electronic device.

However, as electronic devices tend to thin-type day by day, the thickness of the loudspeaker module is limited strictly, and the size of the loudspeaker unit and the size of the acoustic cavity are greatly limited. Thus, the acoustical performance and output power of the loudspeaker module are affected by the loudspeaker units with existing structures to a certain degree. Additionally, there are only simple locational installation and electric connection implementation between the conventional loudspeaker modules and the electronic devices, and the space inside the electronic device is not utilized sufficiently. Accordingly, there is a need to improve the conventional loudspeaker modules and the electronic devices to balance thin-type and acoustical performance of the product.

SUMMARY

In view of the above problems, the objective of the present invention is to provide a loudspeaker module and an electronic device comprising the loudspeaker module to fully utilize the internal spaces of the loudspeaker module and the electronic device, increase the size of the acoustic cavities of the loudspeaker module and the size of the loudspeaker unit, and accordingly improve the acoustical performance of the products.

In order to resolve the above technical problems, the technical solution provided by the present invention is: a loudspeaker module, comprising a loudspeaker unit and a module housing for accommodating and fixing the loudspeaker unit, wherein, sound outlet holes are provided on the module housing, wherein, an accommodating part penetrating the module housing is provided in the module housing, the accommodating part is used for accommodating the loudspeaker unit, a front acoustic cavity and a rear acoustic cavity are formed between the module housing and the loudspeaker unit, respectively, and upper ends and lower ends of the front acoustic cavity and the rear acoustic cavity are open; sealing cushions are provided on an upper end surface and a lower end surface of the module housing, both the upper end surface and the lower end surface of the module housing are hermetically combined with elements of a terminal electronic device through the sealing cushions, so as to seal upper end surfaces and lower end surfaces of the front acoustic cavity and the rear acoustic cavity.

Furthermore, it is preferred that, the sound outlet holes of the loudspeaker module are located on a sidewall of the module housing, and the front acoustic cavity is in communication with the sound outlet holes.

Furthermore, it is preferred that, the loudspeaker unit comprises a vibration system and a magnetic circuit system, the vibration system comprises a vibrating diaphragm and a voice coil bonded to one side of the vibrating diaphragm; the magnetic circuit system comprises a pole plate, a magnet and a yoke that are sequentially combined together, wherein, a sound hole of the loudspeaker unit is provided between an edge of the yoke and the module housing to radiate sound; the rear acoustic cavity is defined as a space in the loudspeaker module corresponding to a front side of the vibrating diaphragm, and the front acoustic cavity is defined as a space in the loudspeaker module corresponding to a rear side of the vibrating diaphragm.

Furthermore, it is preferred that, each of the sealing cushions comprises two closed circular structures combined with each other; an acoustic cavity formed between an upper surface of the module housing and the electronic device is divided into two parts by the sealing cushions; and another acoustic cavity formed between a lower surface of the module housing and the electronic device is divided into two parts by the sealing cushions.

Furthermore, it is preferred that, an upper space of the module housing is partitioned by the sealing cushions to form a portion of the front acoustic cavity and a portion of the rear acoustic cavity, and a lower space of the module housing is partitioned by the sealing cushions to form another portion of the front acoustic cavity and another portion of the rear acoustic cavity; and the portion of the front acoustic cavity at an upper side of the module housing is in communication with the another portion of the front acoustic cavity at a lower side of the module housing; and the portion of the rear acoustic cavity at the upper side of the module housing is in communication with the another portion of the rear acoustic cavity at the lower side of the module housing.

Furthermore, it is preferred that, the sealing cushions are made of foam; and the sealing cushions are fixedly combined with the module housing and the electronic device by bonding.

Furthermore, it is preferred that, the sealing cushions are made of TPU, TPE, or silica gel; and the sealing cushions are integral with the module housing through injection molding process.

Furthermore, it is preferred that, a number of the sound outlet holes is two, and the sound outlet holes are located at a same side of a sidewall of the module housing.

An electronic device, wherein, the upper surface and the lower surface of the module housing are hermetically combined with a circuit board or a device housing, respectively; and the module housing is hermetically combined with the circuit board and the device housing through the sealing cushions.

Preferred, sound outlet hole(s) is/are provided on the device housing; and the sound outlet hole(s) provided on the device housing is/are positioned on a lateral surface of the device housing, and the sound outlet hole(s) of the device housing is/are in communication with the sound outlet holes of the loudspeaker module.

Utilizing the above technical solution, compared with conventional structures, the upper and lower sides of the front acoustic cavity and the rear acoustic cavity of the loudspeaker module provided by the present invention are open, so that the thickness for the top wall and bottom wall of the conventional loudspeaker module is saved, and the upper and lower end surfaces of the front acoustic cavity and the rear acoustic cavity are sealed by the housing and circuit board in the terminal electronic device, so as to replace the top and bottom walls of the conventional loudspeaker module. Such a structure fully utilizes the space of the loudspeaker module and the space of the electronic device, expands the internal space of the loudspeaker module, increases the size of the loudspeaker unit and the sizes of the acoustic cavities, and accordingly improves the acoustical performance of the product.

In order to achieve the above and related objectives, one or more aspects of the present invention comprise the features detailed below and indicated particularly in the claims. Some exemplary aspects of the present invention are described in details by the description below and the accompanying drawings. However, these aspects only indicate some implementations of various implementations of the present invention. In addition, the present invention is intended to contain all of these aspects and the equivalents thereof.

BRIEF DESCRIPTION OF THE DRAWINGS

By referring to the descriptions in connection with the accompanying drawings and the contents of the claims, and with a full understanding of the present invention, other purposes and results of the present invention will be more clearly and easily understand. Wherein:

Same reference numerals in all of the accompanying drawings indicate similar or corresponding features or functions.

DETAILED DESCRIPTIONS

Figure 1:
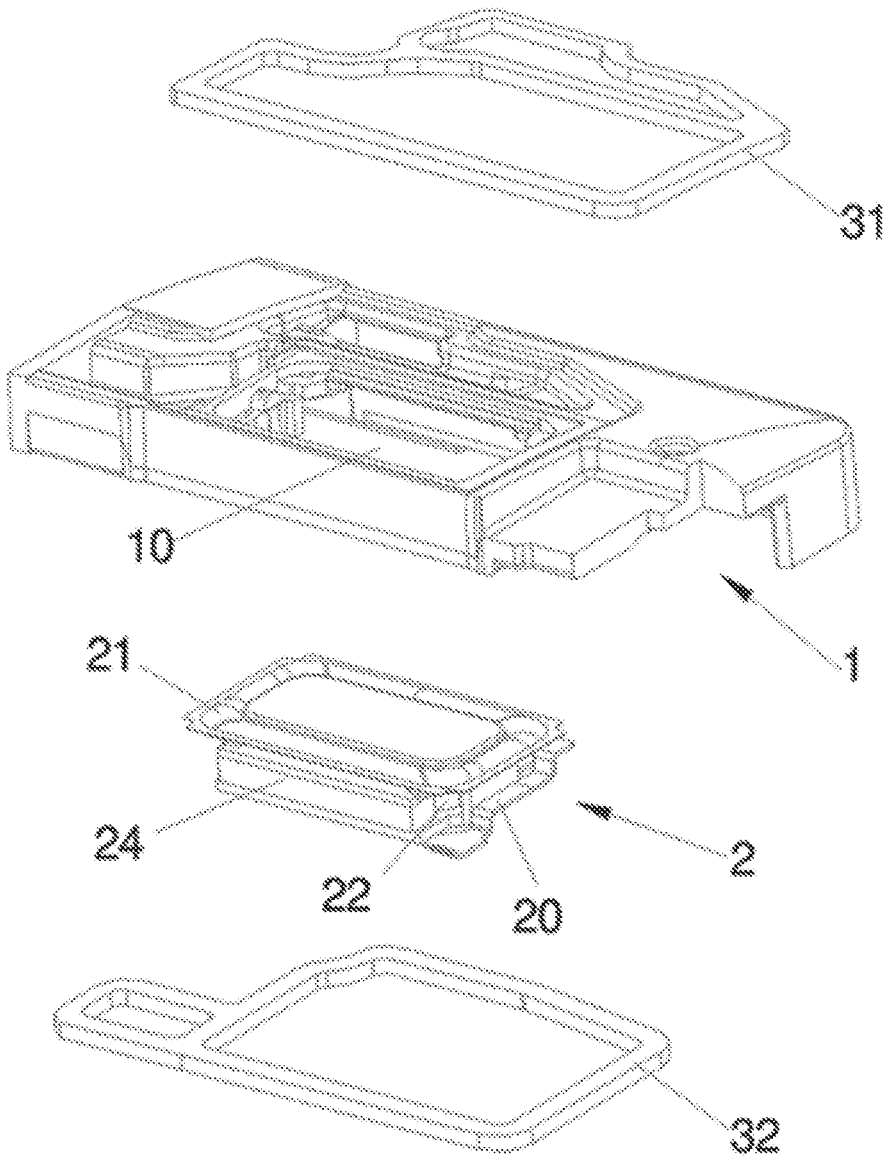
FIG. 1 is a three-dimensional structure exploded view of the loudspeaker module according to the present invention.

In order to resolve the problems in the prior art that the internal space of the electronic device is not fully used, the present invention provides a loudspeaker module and an electronic device comprising the loudspeaker module.

Hereinafter, the technical solution of the present invention will be clearly and integrally described in connection with the accompanying drawings in the embodiments of the present invention, and it should be understood that the described embodiments are only a part of the embodiments of the present invention, but not all the embodiments. Besides, in the description of the embodiments below, for sake of illustration, a number of details are described in order to provide comprehensive comprehending for one or more embodiments, and it should be understood that these embodiments can be embodied without such specific details. All the other embodiments achieved by those skilled in the art based on the embodiments in the present invention without creative labor belong to the scope of the present invention.

FIG. 1 to FIG. 4 show the structure of the loudspeaker module in the embodiments of the present invention from several angles.

As shown in FIG. 1 to FIG. 4, the loudspeaker module provided by the present invention comprises a loudspeaker unit 2 and a module housing 1 for accommodating and fixing the loudspeaker unit 2, and sound outlet holes are provided on the module housing. There is only one housing in the loudspeaker module shown in the embodiment, an accommodating part 10 penetrating the module housing 1 is disposed at a center position of the module housing 1, and the loudspeaker unit 2 is accommodated and fixed in the accommodating part 10. In addition, a front acoustic cavity and a rear acoustic cavity are formed between the module housing and the loudspeaker unit, respectively, and the upper and lower ends of the front acoustic cavity and the rear acoustic cavity are open.

Specifically, the sound outlet holes of the loudspeaker module are located at the lateral surface of the loudspeaker module. The loudspeaker module shown in the embodiment has two sound outlet holes, i.e., a sound outlet hole 13 and a sound outlet hole 14, both of which are located at the same side of the sidewall of the module housing 1. The sound generated by the loudspeaker unit 2 is radiated to outside through the sound outlet hole 13 and the sound outlet hole 14, and providing two sound outlet holes facilitates increasing the radiating area for sound and improving the high-frequency performance of the loudspeaker module.

In the loudspeaker with a conventional structure, the housing of the loudspeaker module together with the speaker unit forms the front acoustic cavity and the rear acoustic cavity of the loudspeaker module, wherein, the rear acoustic cavity is closed, the front acoustic cavity is in communication with the sound outlet hole of the loudspeaker module, so that the sound radiated by the speaker unit is in communication with outside through the sound outlet hole. The loudspeaker module according to the present invention comprises only one module housing 1, and the upper and lower ends of the front acoustic cavity and the rear acoustic cavity formed by the module housing 1 after accommodating the speaker unit 2 are open.

In the present embodiment, the upper and lower sides of the speaker unit are exposed from the module housing 1. The upper surface and lower surface of the module housing 1 are hermetically combined with the elements of terminal electronic device, and the upper and lower end surfaces of the front acoustic cavity and the rear acoustic cavity are sealed by combining with the electronic device. After the upper and lower end surfaces of the front acoustic cavity and the rear acoustic cavity are sealed, the rear acoustic cavity is a closed, and the front acoustic cavity is in communication with the sound outlet holes on the lateral surface.

Figure 4:
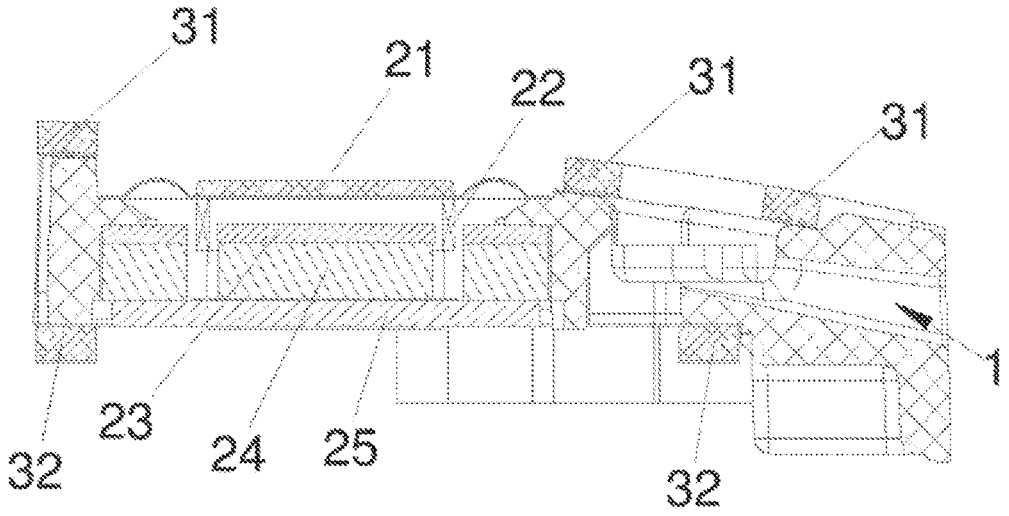
FIG. 4 is a sectional structure view of the loudspeaker module according to the present invention.

FIG. 1 and FIG. 4 show the structure of the loudspeaker unit from different angles. In one specific embodiment of the present invention, the loudspeaker unit 2 comprises a vibration system and a magnetic circuit system, wherein, the vibration system comprises a vibrating diaphragm 21 and a voice coil 22 bonded to the lower side of the vibrating diaphragm 21. The magnetic circuit system comprises a pole plate 23, a magnet 24 and a yoke 25 that are sequentially combined together. In the present embodiment, the magnetic circuit system has a dual magnetic circuit structure which comprises a center magnetic circuit located at the center position and an edge magnetic circuit located at the edge position, and a magnetic gap for accommodating the voice coil 22 is formed between the center magnetic circuit and the edge magnetic circuit, as shown in FIG. 4. In addition, the magnetic circuit system further comprises an electric connecting part 20 electrically connecting the voice coil 22 and the terminal electronic device. As shown in FIG. 1, the voice coil 22 is subjected to stress and vibrates up and down in the magnetic gap formed in the magnetic circuit system after connecting electric signal through the electric connecting part 20, so as to further drive the vibrating diaphragm 21 to vibrate to generate sound.

Figure 2:
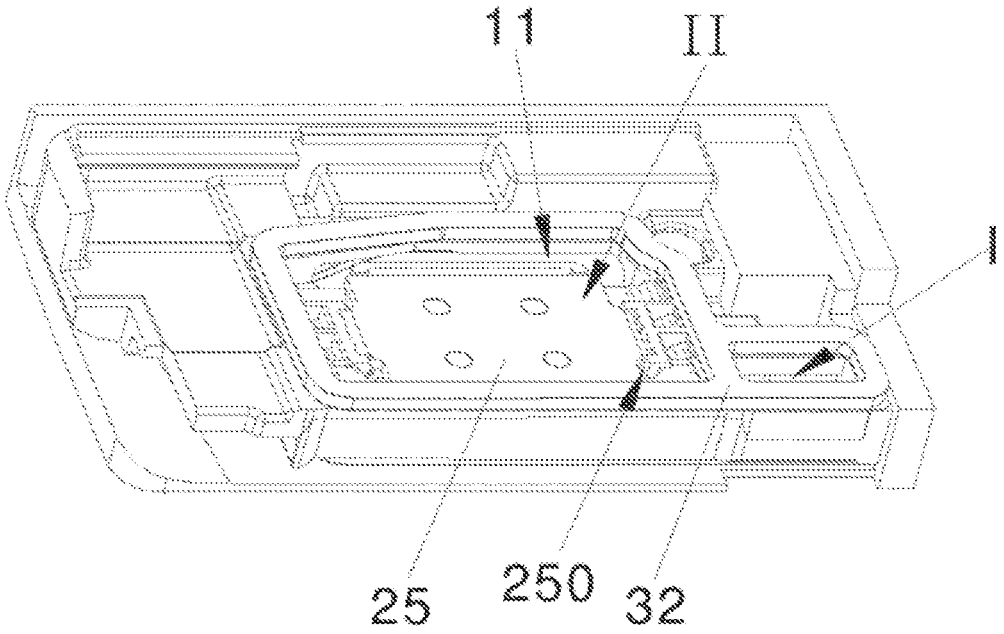
FIG. 2 is a three-dimensional structure view 1 of the loudspeaker module according to the present invention.
Figure 3:
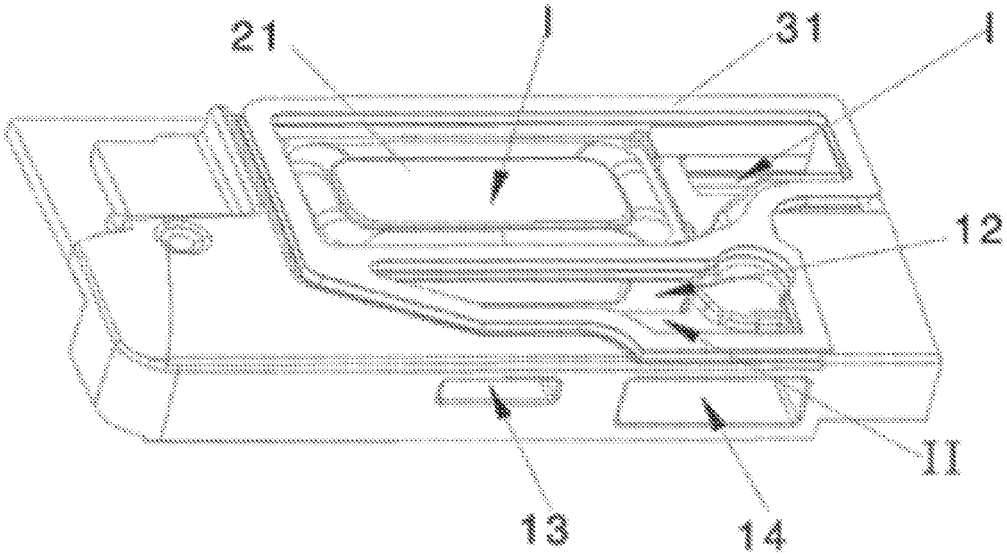
FIG. 3 is a three-dimensional structure view 2 of the loudspeaker module according to the present invention.

Wherein, the front side of the vibrating diaphragm 21 is defined as a side of the vibrating diaphragm 21 away from the voice coil 22, the rear side of the vibrating diaphragm 21 is defined as a side of the vibrating diaphragm 21 closer to the voice coil 22. In the present embodiment, the rear acoustic cavity of the loudspeaker module is defined as a space at the front side of the vibrating diaphragm 21, and the front acoustic cavity of the loudspeaker module is defined as a space at the rear side of the vibrating diaphragm 21. As shown in FIG. 2 and FIG. 3, there is a gap between the edge of the yoke 25 and the module housing 1 for radiating sounds at the rear side of the vibrating diaphragm 21, and the gap is the sound hole 250 of the loudspeaker unit. The sounds are transmitted to the sound outlet hole 13 and the sound outlet hole 14 through an opening 11 and an opening 12 on the module housing 1 after radiated from the sound hole 250, and then is radiated to outside through the sound outlet hole 13 and the sound outlet hole 14. As for the loudspeaker module with relatively small space at the front side of the vibrating diaphragm 21, the above structure can be used, so as to prevent the vibrating diaphragm 21 from colliding with other structures and affecting the effect of sound production when the vibrating diaphragm vibrates. The resonance oscillation of the front acoustic cavity can be reduced and the high-frequency sound effect can be improved by using such a structure.

In a specific embodiment of the present invention, the module housing 1 and the electronic device are hermetically combined through sealing cushions, wherein, the upper end surface of the module housing 1 is provided with a sealing cushion 31, and the lower end surface of the module housing 1 is provided with a sealing cushion 32. One side of the sealing cushion 31 and one side of the sealing cushion 32 are fixedly combined with the module housing 1, and the other side is fixedly combined with the elements of the electronic device. Preferably, the sealing cushion 31 and the sealing cushion 32 are made of foam material, which has good elasticity, thereby facilitating seal between two components, and has relatively higher cost performance. The sealing cushion 31 and the sealing cushion 32 made of foam material are hermetically combined with the module housing 1 and the electronic device by bonding.

In addition, the sealing cushion 31 and the sealing cushion 32 may be made of TPU, TPE or silica gel material, which has good elasticity to enable hermetical combination between the module housing 1 and the electronic device. In addition, the above materials may be fixedly combined with the module housing 1 by injection molding, which can save labor cost and improve accuracy.

In the loudspeaker module according to the present invention, the upper and lower ends of the front acoustic cavity and the rear acoustic cavity are open, by which the thickness for the top wall and bottom wall of the conventional loudspeaker module is saved. With given overall dimension of the loudspeaker module, increasing the internal space of the loudspeaker module facilitates increasing the size of the acoustic cavities and the size of the loudspeaker unit 2, thereby facilitating improving the acoustic performance of the product. The structure with the front acoustic cavity and the rear acoustic cavity hermetically combined through a terminal electronic device enables the front acoustic cavity and the rear acoustic cavity of the loudspeaker module to be sealed, which may ensure proper functioning of the loudspeaker module.

It should be noted that, the sound outlet hole 13 and the sound outlet hole 14 of the loudspeaker module in the present embodiment are in communication with the rear side of the vibrating diaphragm 21, and by combining with specific structure inside the loudspeaker module, the sound radiated from the sound hole 250 of the loudspeaker unit may need to transmit through the opening 11 and the opening 12 so as to be in communication with the sound outlet hole 13 and sound outlet hole 14. By combining with such a structure, each of the sealing cushion 31 and the sealing cushion 32 includes two conjoint and closed circular structures. After any one of the sealing cushions is combined with the module housing 1 and the electronic device, one cavity can be divided into two cavities by the sealing cushion, and the upper cavity is in communication with the lower cavity correspondingly so as to form the front acoustic cavity and the rear acoustic cavity of the loudspeaker module.

FIG. 2 and FIG. 3 show a three-dimensional structure of the loudspeaker module according to the embodiments of the present invention.

As shown in FIG. 2 and FIG. 3 jointly, a space in the loudspeaker module is divided into a front acoustic cavity II and a rear acoustic cavity I through the sealing cushion 31, and another space in the loudspeaker module is divided into a front acoustic cavity II and a rear acoustic cavity I through the sealing cushion 32.

Particularly, the rear acoustic cavity I formed through the sealing cushion 31 and the rear acoustic cavity I formed through the sealing cushion 32 are in communication with each other through the opening, which penetrating the module housing 1, at the lateral side of the vibrating diaphragm 21. The structure provided with a through hole on the module housing 1 facilitates increasing the rear acoustic cavity of the loudspeaker module, thereby improving the low-frequency performance of the product. The front acoustic cavity II formed through the sealing cushion 32 and the front acoustic cavity II formed through the sealing cushion 31 are in communication with each other to form a integrated front acoustic cavity II, wherein, one end of the front acoustic cavity II is communicated through the opening 11 and the opening 12, and the other end of the front acoustic cavity II is communicated through the sound outlet hole 13 and the sound outlet hole 14. The loudspeaker module is provided with two sound outlet holes, i.e., the sound outlet hole 13 and the sound outlet hole 14, which facilitate sound generated by the vibrating diaphragm being radiated to outside, and conducive to improving the high-frequency acoustic performance of the product.

Figure 5:
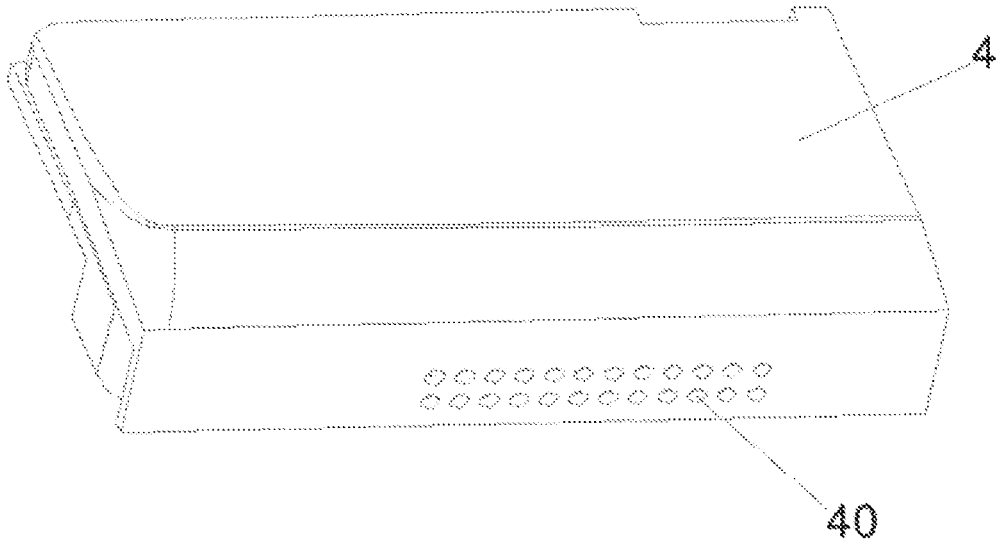
FIG. 5 is a view illustrating partial structure of the electronic device according to the present invention.
Figure 6:
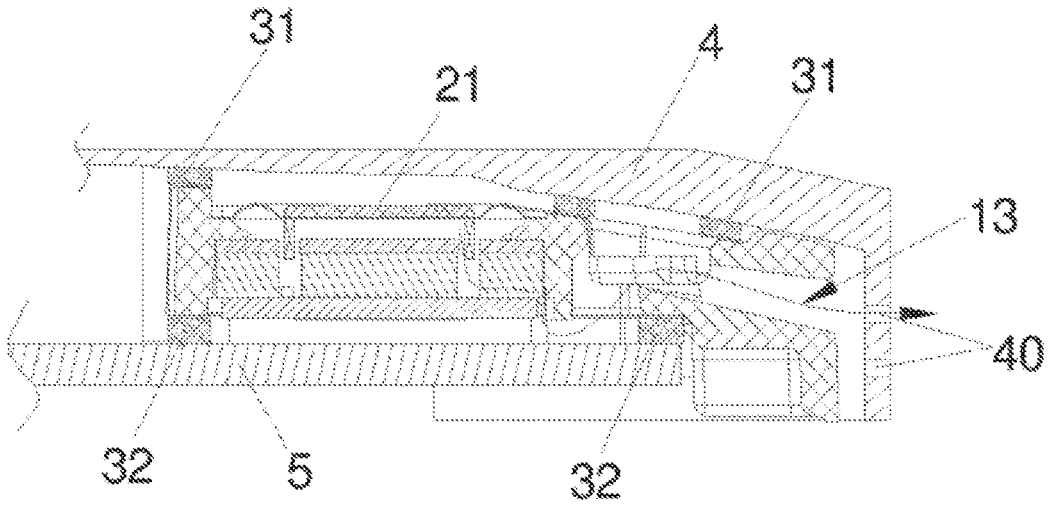
FIG. 6 is a sectional structure view of the electronic device according to the present invention.

FIG. 5 and FIG. 6 show the structure of the electronic device according to the embodiments of the present invention from various angles.

As shown in FIG. 5 and FIG. 6, the front acoustic cavity and the rear acoustic cavity formed in the loudspeaker module are open, and the front acoustic cavity and the rear acoustic cavity are sealed by hermetically combining the surfaces of the module housing 1 with the electronic device. Wherein, the electronic device (such as, a cell phone, pad and the like) comprises a device housing 4 and a circuit board 5. The device housing 4 is hermetically combined with the upper side of the module housing 1 through the sealing cushion 31, and the circuit board 5 is hermetically combined with the lower side of the module housing 1 through the sealing cushion 32. After the device housing 4, the circuit board 5 and the module housing 1 are combined together through the sealing cushions, the rear acoustic cavity of the loudspeaker module is a closed structure, and the front acoustic cavity is only in communication with outside through the sound outlet hole 13 and the sound outlet hole 14.

In addition, the sound outlet hole 13 and the sound outlet hole 14 of the loudspeaker module are positioned on the lateral surface of the loudspeaker module, as shown in FIG. 3. Each of the sound outlet hole 13 and the sound outlet hole 14 is in communication with the sound outlet hole 40 in the lateral surface of the device housing 4, and the sound generated by the loudspeaker unit 2 is in communication with outside through the sound outlet hole 40 after transmitted through the sound outlet hole 13 and the sound outlet hole 14, as shown in FIG. 6 (only the structure of the sound outlet hole 13 is illustrated in FIG. 6).

In the present embodiment, one part of the circuit board 5 combined with the module housing 1 is a planar structure, and one part of the device housing 4 combined with the module housing 1 is a non-planar structure provided correspondingly to the module housing 1.

In addition, the elements inside the electronic device is not limited to a housing and a circuit board, and may be a screen or other internal elements and the like, as long as they can seal the acoustic cavities of the loudspeaker module, and thus each of them falls into the scope of protection of the present invention.

The upper and lower sides of the front acoustic cavity and the rear acoustic cavity of the loudspeaker module provided by the present invention are open, so that the thickness for the top wall and bottom wall of the conventional loudspeaker module is saved, and the upper and lower end surfaces of the front acoustic cavity and rear acoustic cavity are sealed by the housing and circuit board in the terminal electronic device, to replace the top and bottom walls of the conventional loudspeaker module. Such a structure fully utilizes the space of the loudspeaker module and the space of the electronic device, expands the internal space of the loudspeaker module, increases the size of the loudspeaker unit and the sizes of the acoustic cavities, and accordingly improves the acoustical performance of the product.

As described above, the loudspeaker module and the electronic device comprising the loudspeaker module according to the present invention are described by way of example with reference to the accompanying drawings. With the above teaching of the present invention, other improvements and variants, which fall into the scope of protection of the present invention, can be made by those skilled in the art based on the above embodiments. Thus, it will be understood by those skilled in the art that the above specific description aims at better understanding of the present invention, but not limiting the present invention, and the scope of protection of the present invention is limited by the claims and its equivalents.

What is claimed is:

1. A loudspeaker module, comprising a loudspeaker unit and a module housing, wherein, sound outlet holes are provided on the module housing, wherein, an accommodating part penetrating through the module housing is provided in the module housing, the accommodating part receiving and accommodating the loudspeaker unit, with a front acoustic cavity and a rear acoustic cavity between the module housing and the loudspeaker unit, and upper ends and lower ends of the front acoustic cavity and the rear acoustic cavity being open; and sealing cushions are provided on an upper end surface and a lower end surface of the module housing, both the upper end surface and the lower end surface of the module housing being hermetically combined with elements of a terminal electronic device through the sealing cushions, so as to seal upper end surfaces and lower end surfaces of the front acoustic cavity and the rear acoustic cavity.

2. The loudspeaker module according to claim 1, wherein, the sound outlet holes of the loudspeaker module are located on a sidewall of the module housing, and the front acoustic cavity is in communication with the sound outlet holes.

3. The loudspeaker module according to claim 1, wherein, the loudspeaker unit comprises a vibration system and a magnetic circuit system, the vibration system comprises a vibrating diaphragm and a voice coil bonded to one side of the vibrating diaphragm; the magnetic circuit system comprises a pole plate, a magnet and a yoke that are sequentially combined together, wherein, a sound hole of the loudspeaker unit is provided between an edge of the yoke and the module housing to radiate sound; and the rear acoustic cavity is defined as a space in the loudspeaker module corresponding to a front side of the vibrating diaphragm, and the front acoustic cavity is defined as a space in the loudspeaker module corresponding to a rear side of the vibrating diaphragm.

4. The loudspeaker module according to claim 3, wherein, each of the sealing cushions comprises two closed circular structures combined with each other;

an acoustic cavity formed between an upper surface of the module housing and the electronic device is divided into two parts by the sealing cushions; and another acoustic cavity formed between a lower surface of the module housing and the electronic device is divided into two parts by the sealing cushions.

5. The loudspeaker module according to claim 4, wherein, an upper space of the module housing is partitioned by the sealing cushions to form a portion of the front acoustic cavity and a portion of the rear acoustic cavity, and a lower space of the module housing is partitioned by the sealing cushions to form another portion of the front acoustic cavity and another portion of the rear acoustic cavity; and the portion of the front acoustic cavity at the upper space of the module housing is in communication with the another portion of the front acoustic cavity at the lower space of the module housing; and the portion of the rear acoustic cavity at the upper space of the module housing is in communication with the another portion of the rear acoustic cavity at the lower space of the module housing.

6. The loudspeaker module according to claim 1, wherein, the sealing cushions are made of foam; and the sealing cushions are fixedly combined with the module housing and the electronic device by bonding.

7. The loudspeaker module according to claim 1, wherein, the sealing cushions are made of TPU, TPE, or silica gel; and the sealing cushions are integral with the module housing through injection molding process.

8. The loudspeaker module according to claim 1, wherein, a number of the sound outlet holes is two, and the sound outlet holes are located at a same side of a sidewall of the module housing.

9. An electronic device, wherein, the electronic device comprises a circuit board, a device housing, and the loudspeaker module of claim 1, wherein, an upper surface and a lower surface of the module housing are hermetically combined with the circuit board or the device housing, respectively; and the module housing is hermetically combined with the circuit board and the device housing through the sealing cushions.

10. The electronic device according to claim 9, wherein, sound outlet hole(s) is/are provided on the device housing; and the sound outlet hole(s) provided on the device housing is/are positioned on a lateral surface of the device housing, and the sound outlet hole(s) of the device housing is/are in communication with the sound outlet holes of the loudspeaker module.

* * * * *